United States Patent [19]

Nebe et al.

[11] Patent Number: 4,478,900

[45] Date of Patent: Oct. 23, 1984

[54] WOVEN FABRIC CONTAINING PARTIALLY FIBRILLATED TEXTILE YARN

[75] Inventors: Juergen Nebe; Bernhard H. Ladeur, both of Gronau-EPE, Fed. Rep. of Germany

[73] Assignee: Standard Oil Company (Indiana), Chicago, Ill.

[21] Appl. No.: 413,998

[22] Filed: Sep. 2, 1982

[51] Int. Cl.[3] ..... B32B 3/02

[52] U.S. Cl. ..... 428/92; 26/29 R; 428/95

[58] Field of Search ..... 428/95, 92; 26/29 R, 26/2 R

[56] References Cited

U.S. PATENT DOCUMENTS

| | | | |
|---|---|---|---|
| 3,199,284 | 8/1965 | Scragg | 57/157 |
| 3,427,912 | 2/1969 | Nozawa | 83/20 |
| 3,542,632 | 11/1970 | Eickhoff | 428/95 |
| 3,874,965 | 4/1975 | Greenwald | 428/95 |
| 3,981,952 | 9/1976 | Ruddell | 264/147 |
| 4,156,957 | 6/1979 | McKay | 428/95 |

FOREIGN PATENT DOCUMENTS

| | | |
|---|---|---|
| 1073741 | 6/1967 | United Kingdom . |
| 1262853 | 2/1972 | United Kingdom . |

*Primary Examiner*—Marion E. McCamish

*Attorney, Agent, or Firm*—David E. Boone; William T. McClain; William H. Magidson

[57] ABSTRACT

This invention relates to a partially fibrillated textile ribbon yarn, a woven primary backing fabric made therefrom and fine or ultrafine gauge tufted carpets prepared utilizing such a backing fabric.

8 Claims, No Drawings

WOVEN FABRIC CONTAINING PARTIALLY FIBRILLATED TEXTILE YARN

This invention relates to a partially fibrillated textile ribbon yarn. More particularly this invention relates to a textile ribbon yarn which is about 60 percent to about 80 percent fibrillated, woven primary backing fabric made therefrom and fine or ultrafine gauge tufted carpets prepared utilizing such primary backing fabric.

A tufted carpet ordinarily has at least two parts. The first is a primary backing and the second is tufted pile loops which pass through and are supported by the primary backing. These pile loops which can be either cut or uncut project from one side of the primary backing and are usually connected by loops on the reverse or floor side of the backing.

In manufacturing tufted fabrics such as carpets and rugs, the primary backing is advanced through a needle tufting machine. The pile yarns are borne by a bank of reciprocating needles which extend transversely across the primary backing and pierce the backing material. As the needles are withdrawn, looper members of the machine serve to hold the inserted yarns, thereby forming on the moving backing row upon row of pile loops which project through the backing. In the completed fabric, the crests of the loops either remain connected or they are severed depending on whether a loop pile or a cut pile fabric is desired.

In recent years tufted fabrics having finer tufting gauges and shorter pile heights have become commercially more important. "Fine gauge" is used herein to denote fabrics tufted with about 5 or more tufting needles per inch (about 20 or more per decimeter) in the weft or fill direction. Fine gauges in the carpet industry generally run from about 10 tufting needles per inch to about 20 tufting needles per inch (about 39 per decimeter to about 79 per decimeter) in the weft direction. The term "1/10 inch gauge" corresponds to 10 tufting needles per inch. Pile heights, deniers, and stitches per centimeter in the warp direction vary from style to style such that no exhaustive correlation can be made. Generally, in fine gauge tufting, pile heights are in the range from 3 millimeters to about 15 millimeters; pile deniers are in the range 40 tex to about 250 tex, but texes as high as about 300 are not unknown, and stitches per inch in the warp direction are in the range of about 5 to about 30 (about 20 to about 118 per decimeter).

The term "tex number" of a yarn is used in the art and is defined for purposes of this application as the weight in grams of one kilometer of yarn. The term "dtex" refers to a unit which is one-tenth of a tex.

As used herein the term "warp" yarn refers to yarn which runs in the machine direction (longitudinally) of the woven fabric. Ine term "weft" or "fill" refers to yarn which runs transverse to the direction of travel of the fabric from the loom (machine direction). The terms "ribbon yarn" and "tape" are used interchangeably herein.

As the tufting gauges have become finer, i.e., more needles per inch, and pile heights shorter, any discontinuities arising from either needle or tape deflection become very noticeable.

There are two principal problems encountered in producing fine gauge tufted fabrics: (1) needle deflection or tape deflection; and (2) dimensional stability of the tufted fabric.

The "needle deflection or tape deflection" can be seen in a carpet surface as irregular pile yarn density including holes and rills, uneven pile heights and poor pattern definition. This is the result of the tufting needles not penetrating the normally narrow warp tapes of the primary backing. This is particularly a problem with woven tape or woven slit film primary backing fabrics such as disclosed by T. M. Rhodes in U.S. Pat. No. 3,110,905 (1963). When the tufting needles do not penetrate the tape then either the needle itself is deflected or the tape is deflected. When this random deflection occurs, the pile yarn stitches will be uneven giving the appearance problems discussed above.

In addition to needle deflection, the problem of dimensional stability also exists with fine gauge tufting of woven backing fabrics. As discussed by J. R. Starr et al. in U.S. Pat. No. 3,819,462 (1974), in fine gauge, high pile density carpets, the structural components of the woven backing may be broken by the tufting needles to the extent that the backing fabric may be left with insufficient strength to prevent bowing or skewing of the fabric as it moves through later processing.

Attempts have been made in the art to eliminate the deflection and stability problems discussed above with woven tape or woven slit film primary backings.

H. A. Schwartz et al. in U.S. Pat. No. 3,359,934 (1967) disclose the use of "multi-sectional yarn" preferably as weft or fill yarn woven with flat, ribbon-like mono-filament warp yarns. While this fabric has value for coarser gauge tufting, needle deflection is still a problem for fine gauge tufting operations.

M. I. Port et al. in U.S. Pat. No. 4,123,577 (1978) disclose a primary backing for tufted carpets which comprises a woven, nonwoven, or knitted substrate capable of being tufted to which a web of blended fibers is heat fused in a calendering process. While this backing is useful for fine gauge tufting, it requires that a web of fibers be heat fused to the woven substrate.

J. N. Ruddell et al. in U.S. Pat. No. 3,981,952 (1976) teach that the use of a tape having a homogenous series of high frequency discrete deformations in a woven backing fabric reduces the "bursting" of the tape during tufting thereby enabling finer tufting to be achieved and reducing the strength loss due to tufting. However, we have found that the mechanical stress of the weaving and tufting loom causes the splitting off of fibrils from such "profiled" tapes. When these profiled tapes are used as the warp yarn in woven primary backing fabric, this splitting results in lower weaving efficiency and a less even carpet pile than when the fibrillated yarn of the instant invention is used.

The use of rows of needles or teeth on rollers as well as other types of mechanical fibrillators to form such parallel rows of slits is well known in the art. For example, British Pat. No. 1,073,741 (1967) discloses a process for producing unconnected rows of generally parallel splittings along the length of a continuously moving strip, tube or sheet of oriented synthetic resinous material. British Pat. No. 1,262,853 (1972) discloses several mechanical fibrillators. M. Nozawa et al. in U.S. Pat. No. 3,427,912 disclose a process for manufacturing yarns from a slit film by guiding the film around and in contact with a portion of the peripheral surface of a roller having cutting edges which extend through and slit the film substantially in the direction of travel of the film. Nozawa also teaches that the peripheral speed of the roller can be changed relative to the film speed to affect the length of the slit produced in the film. I.

Scragg in U.S. Patent No. 3,199,284 (1965) discloses a process for manufacturing a textile yarn by slitting a tape at a plurality of closely-spaced locations along the tape. The slit tape is then drawn longitudinally before being transversely expanded. The transversely expanded tape is then broken at a plurality of locations to provide a strip with a plurality of free projecting portions. This tape can be twisted alone or together with other similarly treated strips to yield a "non-pilling" yarn. It is also practiced in the industry to "needle" woven fabric to decrease needle deflection during tufting. We have found, however, that following the teachings of these references and practices produces a fabric having either unacceptable needle deflection and/or unacceptably low dimensional stability.

In view of the above-described problems, it is desirable to have a primary backing fabric capable of being fine gauge tufted which has good dimensional stability.

It is an object of this invention to provide a partially fibrillated tape yarn which can be used to prepare a woven primary backing fabric which is capable of being fine gauge tufted and has good dimensional stability.

It is another object of this invention to provide a woven fabric which is capable of being fine gauge tufted and which has good dimensional stability.

It is a further object of this invention to provide a process for producing a partially fibrillated yarn which can be used to prepare a woven primary backing fabric.

It is another object of this invention to provide a fine gauge tufted carpet in which a minimum amount of needle deflection has occurred and which has good dimensional stability.

Other objects appear hereinafter.

We have found that a fabric suitable for use as a primary backing for fine and ultrafine gauge tufting can be obtained by using as the warp yarn a ribbon yarn which is about 60 percent to about 80 percent fibrillated. This is surprising in view of the teaching of Schwartz et al. that the weft or filling yarn has a greater effect on the tufting characteristics of a primary backing fabric than the warp yarn.

As used herein the term "fibrillate" refers to slitting or cutting a ribbon yarn in an essentially longitudinal direction to form a plurality of essentially parallel rows of slits with the rows displaced laterally with respect to one another. The longitudinal portion of the ribbon which contains these rows of slits constitutes the fibrillated portion of the ribbon. The longitudinal portion of the ribbon between these rows of slits constitutes the unfibrillated portion.

The term "fibrillated portion" is used herein to mean that portion of the longitudinal surface of the ribbon yarn which contains longitudinal rows of slits. The term "percent fibrillation" refers to the percent of the surface of the ribbon yarn which is longitudinally fibrillated. For example, if a ribbon yarn is described as being "80 percent fibrillated," it is meant that about 80 percent of the surface of the ribbon yarn contains longitudinal rows of slits and the remaining portion of the longitudinal surface of the ribbon yarn is unfibrillated. The method by which the fibrillated and unfibrillated portions of the ribbon yarn are determined is discussed hereinbelow.

One aspect of this invention is a textile ribbon yarn which comprises a macromolecularly orientable thermoplastic polymer formed into a ribbon with a linear density of about 200 to about 600 dtex and which has been about 60 percent to about 80 percent of its surface area longitudinally fibrillated.

Another aspect of this invention is a woven fabric suitable for being fine and ultrafine gauge tufted comprising in the warp direction a ribbon yarn which has about 60 percent to 80 percent of its surface area longitudinally fibrillated.

Another aspect of this invention is a process for producing a woven fabric suitable for fine and ultrafine gauge tufting comprising the steps of (a) forming a ribbon yarn from a macromolecularly orientable thermoplastic polymer, (b) orienting said ribbon yarn, (c) contacting said ribbon yarn as it travels with a fibrillating means at a fibrillating means to yarn speed ratio between about 1.1 to 1.0 and 1.5 to 1.0, (d) weaving a fabric using the fibrillated ribbon yarn from step (c) as the warp yarn.

Another aspect of this invention is a tufted carpet comprising (a) a woven primary backing having a ribbon yarn in the warp direction which has about 60 percent to about 80 percent of its surface area longitudinally fibrillated and (b) tufted pile loops which pass through and are supported by said primary backing, said pile loops being present to the extent of at least about 2 per centimeter in tufting cross direction and at least about 2 per centimeter in the machine direction.

The partially fibrillated ribbon yarns of the instant invention are preferably ribbon-like, film tapes of relatively flat cross-section which are highly oriented in the longitudinal direction and are about 60 percent to 80 percent fibrillated. These film tapes can be produced by slitting an extruded film web or by the direct extrusion of the tape itself. The longitudinal orientation is ordinarily accomplished by drawing the film web or the tape while the polymer is in a heated condition to irreversibly stretch the material thereby orienting its molecular structure and increasing its tensile strength. The resulting ribbon yarns preferably have a linear density of about 200 to about 600 dtex. The width of the ribbon yarns is limited only by the ease of weaving and by the dimensional stability and overall strength of the fabric produced. Preferably the ribbon yarn is about 0.8 to about 2.5 millimeters in width. The thicker the ribbon yarn the more difficult the yarn is to fibrillate and the harder it is for tufting needles to penetrate the unfibrillated portions; whereas, if the tape yarn is too thin, it tends to break too easily during weaving.

The materials which are useful for preparing the tape yarn are macromolecularly orientable synthetic polymers such as polyolefins, polyesters especially polyalkylene terephthalates, polyamides and polyvinyls. Preferably these materials include: polymers of propylene, polymers of ethylene, polyethylene terephthalate, polycaprolactam, and poly(hexamethylene adipamide).

The ribbon yarn, after the stretching or orientation process and preferably prior to annealing, is partly fibrillated in such a way that the unfibrillated part in the longitudinal direction of the tape is about 20 percent to about 40 percent and the fibrillated part in the longitudinal direction of the tape is about 60 percent to about 80 percent.

The "percent fibrillation" is an essential feature in the ribbon yarns of the instant invention. When a woven primary backing fabric is prepared with a warp yarn which is less than about 60 percent fibrillated, the fine gauge tufting needles frequently deflect during the tufting operation giving an irregular pile yarn density in the resulting tufted carpet. If the warp yarn is more than about 80 percent fibrillated, there is an unacceptable decrease in the dimensional stability of the tufted carpet. While acceptable primary backing fabric can be obtained using warp yarn which is between about 60 percent and about 80 percent fibrillated, best results are obtained with yarn which is between about 65 percent and about 75 percent fibrillated. The method used to determine this percent fibrillation is discussed hereinbelow.

The fibrillating means can be any type of fibrillator known in the art which is capable of producing essentially parallel rows of slits. As hereinabove stated, examples of such devices are given in British Pat. No. 1,073,741, British Pat. No. 1,262,853 and U.S. Pat. No. 3,427,912 which are incorporated herein by reference. Preferably fibrillation is achieved on a standard pin roll fibrillator using pin bars having 20 to 60 and preferably 35 to 45 needles per centimeter. The maximum length of the needles in the pin bar should be less than about 80 percent and preferably about 50 percent of the tape width. The angle of the needles which is the angle between the radius of the needle roller and the needle can affect the length of the slit formed in the tape. Other things being equal if the angle of the needles is zero degrees, the needles could just punch holes in the tape if a fibrillation ratio of 1.0 (as defined hereinbelow) is utilized. Therefore, the angle of the needles should be about 15 degrees to about 45 degrees and preferably about 30 degrees. The needle position in the pin bars can be straignt or staggered. The distance between needles which are alligned axially on the roller affects the speed at which the fibrillator must rotate relative to the speed of the tape. Other things being equal, the greater the distance between axially alined needles the higher the fibrillation ratio must be to achieve the same percent fibrillation in the tape. The fibrillation ratio which is the ratio of the fibrillator speed to tape speed should range from about 1.0 to about 1.5 to 1.0 and preferably between about 1.1 to about 1.3 to 1.0.

The woven primary backing fabric of the instant invention is preferably prepared by interweaving the partially fibrillated ribbon yarn described hereinabove as warp yarn with weft or filling yarns of synthetic polymeric materials. The weave is preferably a conventional plain weave having at least about 5 warp ends per centimeter and preferably at least about 6 to about 20 warp ends per centimeter and most preferably 11 to 20 warp ends per centimeter. The number of picks (weft yarn ends) used in the fabric depends on the type of yarn used as weft, the tufting stitches and gauge, the dimensional stability requirements of the fabric, economics, ease of weaving and other factors known to those skilled in the art. Generally the number of picks can range from about 4 to about 14 per centimeter. The fill yarn can comprise about 30 to about 70 weight percent of the total weight of the primary backing fabric. Preferably the fill yarn comprises about 45 to about 55 weight percent of the total weight of the primary backing fabric.

The weft (fill) yarn can be unfibrillated ribbon yarn, partially fibrillated ribbon yarn similar to that used for the warp, or profiled ribbon yarn. Fabric made using multifilament yarn as the weft has been found to lack dimensional stability so that ribbon yarn should be used to provide sufficient stability to the fabric. The ribbon yarn should be as thin as possible to allow for ease of penetration of the tufting needles but have sufficient strength to not fracture when the needle penetrates. The linear density of the fill yarn can be about 300 to about 1500 dtex. Preferably the linear density of the fill yarn is about 300 to about 1100 dtex. If the yarn is greater than about 1500 dtex then excessive needle deflection and even needle breakage can occur especially with nonstaggered needle bars. When the linear density of the yarn is less than about 300 dtex, the yarn has insufficient strength resulting in broken picks during weaving and tufting. Consequently, the use of unfibrillated ribbon yarn as fill is not preferred when the tufting is coarser than 1/10 inch gauge (less than about 4 tufts per centimeter in the fill direction) and less than 4 stiches per centimeter in the machine direction.

Partially fibrillated ribbon yarn is preferred as fill yarn for backing fabric which is to be tufted with about 4 to about 12 stitches per centimeter in the machine direction and with at least a 1/10 inch gauge in the fill direction. The degree of fibrillation of the fill yarn should be the same as the warp yarn, that is about 60 percent to about 80 percent fibrillated. Primary backing fabric prepared with partially fibrillated yarn in both directions gives a tufted carpet with an improved pile appearance even for fine and ultrafine cut piles. There is a drawback in that there is some loss in dimensional stability; however, this can be overcome by increasing the linear density and/or the number of picks of the partially fibrillated fill yarn. The linear density of the partially fibrillated fill yarn should range from about 300 to about 600 dtex.

Ribbon yarn which contains multiple grooves in the longitudinal direction can also be used as fill yarn. These grooves are normally made by hot or cold roll embossing or die head profiling. The ribbon yarn containing such grooves is referred to herein as "profiled yarn." The profiled yarn useful as fill yarn for the instant invention should contain at least about 1.8 grooves per millimeter with a preferred range of about 1.8 to about 6.0 grooves per millimeter. The denier of the profiled yarn should be about 500 to about 1100 dtex with a width of about 1.5 to about 2.5 millimeters. Before tufting, profiled yarn has higher strength at a given denier than the partially fibrillated yarn. During tufting, however, the profiled weft yarn fibrillates in an uncontrolled manner which for deniers finer than about 500 dtex can result in such low strength that the resulting carpet tears during the finishing process.

In order to anchor the pile yarns and if necessary impart additional body to the tufted fabric, a secondary backing can be applied to the underside of the tufted primary backing. This secondary backing is ordinarily laminated to the primary backing by means of an adhesive. The adhesive is commonly applied in the fluid state and forms a film-like coating in the spaces between the warp and fill yarns of both the primary and secondary backings. This adhesive is then allowed to harden or is cured to bond the secondary backing to the primary backing.

While the invention is described in connection with the specific examples below, it is understood that these are provided for illustrative purposes only. Many alternatives, modifications, and variations will be apparent to those skilled in the art in light of the examples hereinbelow and such alternatives, modifications, and variations fall within the scope and spirit of the appended claims.

PREPARATION OF A FIBRILLATED RIBBON YARN

Polypropylene resin with a melt flow of about 3 grams per 10 minutes measured at 230° C. and at load of 2.16 kilograms (kg) was extruded at about 250° C. to form a film web about 90 micrometers thick. The web was cooled in a water bath at about 35° C. and slit using multiple knives to provide multiple tape yarns each with a width of about 2.3 millimeters and a linear density of about 2000 dtex. The tape yarn was uniaxially stretched by passing the yarn around a rotating first roller and then around a second roller rotating 6 times faster than the first to provide a stretch ratio of 6 to 1. The resulting oriented tape was then fibrillated using a pin roll fibrillator having 40 needles per centimeter (cm). The needles were 0.05 cm in length and were oriented at a 30° angle to the radius of the roll. The needle position was staggered relative to the width of the tape. The fibrillation ratio was 1.17 to 1.0 (ratio of speed of pin roll to tape speed). This provided a percent fibrillation of 70 percent measured as described hereinbelow. After fibrillation, the tape was passed over annealing cans at a temperature of about 160° C. and a residence time of about 1 second. The resulting yarn was wound in a standard manner on spindles and used to weave primary backing fabric.

The percent fibrillation of the fibrillated tape was determined by the following method. A marking line 100 millimeters long was drawn on a plexiglass plate approximately 150×60 millimeters in size. Double adhesive tapes were placed at each end of the marking line. A test specimen of fibrillated tape was adhered to the plate with the tape positioned so that either 50 percent of a fibrillated or 50 percent of a nonfibrillated part of the test specimen was located at one end of the marking line. All of the nonfibrillated parts of the test specimen within the calibrated length were measured using a projecting microscope as were the fibrillated parts. The nonfibrillated parts of the test specimen are those regions which are essentially unfibrillated, i.e., a single slit can extend into the region but the majority of slits terminate at the edge of the unfibrillated region. The fibrillated parts of the test specimen are those regions which are essentially fibrillated, i.e., the majority of the slits extend through most of the region. The sum of all of the fibrillated parts (total length of all fibrillated regions) divided by the length of the test specimen (100 millimeters) multiplied by 100 gives the percent of fibrillation. Similarly, the sum of all unfibrillated parts divided by the length of the test specimen multiplied by 100 gives the percent of unfibrillated tape.

PREPARATION OF A WOVEN PRIMARY BACKING FABRIC

The primary backing fabric was woven on a Sulzer loom using tape yarn which was 70 percent fibrillated with a linear density of 300 dtex as the warp yarn and 400 dtex, 60 percent fibrillated yarn as the fill yarn. The fabric had a plain weave construction with a tape count of 114 warp ends and 114 picks per 10 centimeters. This was labeled Run 1. Test results are given in Table I.

Run 2 was prepared using 70 percent fibrillated, 300 dtex tape yarn in the warp and 70 percent fibrillated, 400 dtex tape yarn in the weft. The weave had 114 warp ends and 140 picks (weft ends) per 10 centimeters.

Run 3 was prepared using 70 percent fibrillated tape yarn with a denier of 300 dtex as the warp. A die head profiled tape with a denier of 850 dtex was used as the weft. This profiled tape was prepared by extruding molten polypropylene through a die head to give a film 1800 millimeters in width with 1.0 grooves per millimeter. This film was then cut to size, drawn and annealed resulting in a profiled tape with 2.6 grooves per millimeter. The primary backing fabric was woven as described hereinabove to have 114 warp ends and 72 weft ends per 10 centimeters.

Run 4 was prepared using 70 percent fibrillated, 300 dtex tape yarn in the warp and 850 dtex profiled yarn having 2.6 grooves per millimeter in the weft. The fabric had 114 warp ends and 64 weft ends per 10 centimeters.

Run 5 was prepared as a comparator using unfibrillated tape yarn in both the warp and weft directions. The linear density of the tape was 475 dtex for warp and 850 dtex for the weft. The fabric had 89 warp ends and 62 weft ends per 10 centimeters.

Test properties for these fabrics from these runs are given in Table I.

TABLE I

| | Backing Fabric | | | | |
|---|---|---|---|---|---|
| Run No. | 1 | 2 | 3 | 4 | 5 |
| Tape Count[a] | | | | | |
| Warp | 114 | 114 | 114 | 114 | 89 |
| Weft | 114 | 140 | 72 | 64 | 62 |
| Linear Density[b] | | | | | |
| Warp | 300 | 300 | 300 | 300 | 475 |
| Weft | 400 | 400 | 850 | 850 | 850 |
| Tens. S.[c] | | | | | |
| Warp | 56 | 60 | 55 | 52 | 75 |
| Weft | 78 | 90 | 106 | 101 | 80 |
| Elong. Brk.[d] | | | | | |
| Warp | 15 | 17 | 13 | 18 | 23 |
| Weft | 13 | 19 | 14 | 28 | 18 |
| Tot. Wt. ($g/m^2$)[e] | 85 | 100 | 105 | 95 | 95 |

[a]Count of tapes per 10 cm, method DIN 53 853
[b]Linear density in dtex, method DIN 53 830
[c]Tensile strength in deka Newtons/5 cm, method DIN 53 857
[d]Elongation at break in percent, method DIN 53 857
[e]Total weight of fabric in $g/m^2$, method DIN 53 352

These properties show that woven fabric using partially fibrillated tape yarn in both the warp and weft has good strength at lower linear density and lower total fabric weight than fabric prepared with profiled tape in the weft.

PREPARATION OF A TUFTED CARPET

The primary backing fabric prepared as described above was tufted on a 1/16-inch gauge cut pile machine. A spun yarn of 850 dtex was used as the pile yarn. The gauge of the tufting was 16 needles per inch. The number of stitches ranged from 7 to 10 per centimeter. These tufted carpets were evaluated with the results given in Table II.

Tufted carpet was prepared from each of these primary backing fabrics as described hereinabove. The linear density of the pile yarn and the gauge of the tufting are given in Table II.

The appearance of the tufted fabric was subjectively determined by rating the fabric on a scale of 1 to 10 with 1 being poor, i.e., having uneven pile height, irregular pile density, holes, rills, and unacceptable pattern definition. A 10 rating fabric was outstanding in all of these categories.

There is not an objective method for the measurement of carpet stability in the carpet industry. The stability is individually judged by considering the bowing and skewing of the carpet in the finishing stage. This distortion can be distinctly seen when geometric designs are used. Such bows and skews in the final product should not exceed 1.0 percent of the carpet width measured at any place from a straight line across the carpet. The stability of the tufted fabric was assessed by the degree of bowing and skewing during carpet finishing in comparison to a nonwoven primary backing. The rating scale was 1 to 10 as above.

TABLE II

| | Tufted Fabric | | | | |
|---|---|---|---|---|---|
| Backing Run No.: | 1 | 2 | 3 | 4 | 5 |
| Tuft Lin. Den.[a]: | 850 | 500 | 1500 | 1300 | 1300 |
| Gauge[b]: | 1/16 cut | 1/20 cut | 1/10 cut | 1/10 loop | 1/10 loop |
| Appearance[c]: | 10 | 10 | 8 | 7 | 2 |
| Stability[d]: | 7 | 8 | 7 | 6 | 7 |

[a]Linear Density (dtex) of tufting yarn
[b]Gauge of Tufting needles per inch
[c]Rating of appearance on a subjective scale of 1–10
[d]Stability of tufted fabric These results show that tufted fabric prepared with backing fabric containing partially fibrillated yarn, i.e., Runs 1-4, had superior appearance to that prepared with unfibrillated yarn, i.e., Run 5. The stability of the tufted fabric from Runs 1-4 (partially fibrillated) stability were also judged to be comparable to that of Run 5 (unfibrillated).

We claim:

1. Woven fabric useful as primary carpet backing suitable for fine gauge tufting comprising (A) in the warp direction a tape formed from a macromolecularly orientable thermoplastic polymer said tape having a linear density of about 200 to about 600 dtex with about 60 percent to about 80 percent of its surface area longitudinally fibrillated and (B) a fill yarn selected from the group consisting of the tape of part A above, a profiled tape having at least about 1.8 profiles per millimeter with a linear density of 500 to 1100 dtex, or an unfibrilliated tape haivng linear density of about 300 to about 1500 dtex.

2. Woven fabric of claim 1 wherein said thermoplastic polymer is polyprolene and said fill yarn is polypropylene tape with a linear density of about 500 dtex to about 1100 dtex which is profiled with about 1.8 to about 6 grooves per millimeter.

3. Woven fabric of claim 1 wherein said thermoplastic polymer is polypropylene and said fill yarn comprises up to about 30 to about 70 weight percent of the total weight of said fabric.

4. Woven fabric of claim 1 wherein said thermoplastic polymer is polypropylene and said fill yarn is polyproylene tape with a linear densityu of about 300 to about 600 dtex having about 60 percent to about 80 percent of its surface area longitudinally fibrillated.

5. A tufted carpet comprising (a) a woven primary backing having a textile tape in the warp direction said tape comprising a macromolecularly orientable thermoplastic polymer formed into a tape with a linear density of about 200 to about 600 dtex and having about 60 percent to about 80 percent of its surface area longitudinally fibrillated and (b) tufted pile loops which pass through and are supported by said primary backing, said pile loops being present to the extent of at least about 4 per centimeter in tufting cross direction and at least about 4 per centimeter in the machine direction.

6. The tufted carpet of claim 5 wherein said thermoplastic polymer is selected from the group consisting of polypropylene, polyethylene, polyethylene terephthalate, polycaprolactam or poly(hexamethylene adipamide).

7. The tufted carpet of claim 5 where said thermoplastic polymer is polypropylene.

8. A process for producing a woven fabric suitable for fine and ultrafine gauge tufting comprising the steps of (a) forming a ribbon yarn from a macromolecularly orientable thermoplastic polymer, (b) orienting said ribbon yarn, (c) contacting the oriented ribbon yarn of step (b) as it travels with a fibrillating means at a fibrillating means speed to yarn speed ratio between about 1.1 to 1.0 and 1.5 to 1.0 to produce a tape having about 60 percent to about 80 percent of its surface area longitudinally fibrillated, (d) weaving a fabric using the fibrillated tape from step (c) as the warp yarn.

* * * * *

UNITED STATES PATENT OFFICE
CERTIFICATE OF CORRECTION

Patent No. 4,478,900 Dated October 23, 1984

Inventor(s) Juergen Nebe and Bernhard H. Ladeur

It is certified that error appears in the above-identified patent and that said Letters Patent are hereby corrected as shown below:

Patent reads:

| | | |
|---|---|---|
| 1 | 56 | "Ine" and should read --The-- |
| 2 | 68 | "I." and should read --F.-- |
| 5 | 30 | "straignt" and should read --straight-- |
| 5 | 31 | "alligned" and should read --alined-- |
| 9 | 42-43 | "unfibrilliated" and should read --unfibrillated-- |
| 9 | 43 | "haivng" and should read --having-- |
| 10 | 2 | "polyprolene" and should read --polypropylene-- |
| 10 | 12 | "densityu" and should read --density-- |

Signed and Sealed this

*Eleventh* Day of *June 1985*

[SEAL]

*Attest:*

DONALD J. QUIGG

*Attesting Officer* *Acting Commissioner of Patents and Trademarks*